US006799097B2

(12) United States Patent
Villarreal Antelo et al.

(10) Patent No.: US 6,799,097 B2
(45) Date of Patent: Sep. 28, 2004

(54) INTEGRATED RAILROAD SYSTEM

(75) Inventors: Marco Antonio Villarreal Antelo, Tucson, AZ (US); Luiz Steinberg, Recifa (BR); Tak Tong Chan, Tucson, AZ (US)

(73) Assignee: Modular Mining Systems, Inc., Tucson, AZ (US)

( * ) Notice: Subject to any disclaimer, the term of this patent is extended or adjusted under 35 U.S.C. 154(b) by 0 days.

(21) Appl. No.: 10/178,628

(22) Filed: Jun. 24, 2002

(65) Prior Publication Data

US 2003/0236598 A1 Dec. 25, 2003

(51) Int. Cl.[7] ..... G06F 19/00; G06F 7/00

(52) U.S. Cl. ..... 701/19; 701/205; 701/117; 246/76

(58) Field of Search ..... 701/19, 20, 204, 701/207, 213, 211, 117, 119, 29, 31, 35, 205; 342/357.13, 36; 455/456.3, 456, 457; 246/62, 166, 121, 167 R, 182 R, 76; 709/203

(56) References Cited

U.S. PATENT DOCUMENTS 5,429,329 A * 7/1995 Wallace et al. ..... 246/166
5,950,966 A * 9/1999 Hungate et al. ..... 246/62
6,125,311 A * 9/2000 Lo ..... 701/29
2002/0129104 A1 * 9/2002 Trossen ..... 709/203
2002/0147023 A1 * 10/2002 Sawada et al. ..... 455/456
2003/0055666 A1 * 3/2003 Roddy et al. ..... 705/1

* cited by examiner

*Primary Examiner*—Thomas G. Black
*Assistant Examiner*—Ronnie Mancho
(74) *Attorney, Agent, or Firm*—Antonio R. Durando; Quarles & Brady Streich Lang LLP

(57) ABSTRACT

A railroad traffic control system that links each locomotive to a control center for communicating data and control signals. Using on-board computers, GPS and two-way communication hardware, rolling stock continuously communicate position, vital sign data, and other information for recording in a data base and for integration in a comprehensive computerized control system. The data base includes train schedules for real time display on train monitors. The current position of each train is compared to its planned schedule online to provide immediate information to the dispatcher to determine whether a corrective action is necessary. When a train's deviation from its planned schedule exceeds a predetermined parameter, the system automatically calculates alternative schedules for all trains in the system according to preselected operational constraints as necessary to minimize the effect of the deviation.

32 Claims, 8 Drawing Sheets

INTEGRATED RAILROAD SYSTEM

BACKGROUND OF THE INVENTION

1. Field of the Invention

This invention is related in general to the field of railroad operation and, in particular, to an integrated system for controlling the interaction among trains and other vehicles on the system's tracks to ensure safety and efficiency.

2. Description of the Related Art

Railroads are operated throughout the world using tested technology and procedures designed to guarantee passenger safety and to safeguard the integrity of the rail system. The approaches taken by railroad operators to perform various functions have been adopted with substantial uniformity throughout the industry. As a result, railroads tend to operate in conservative fashion and changes are implemented slowly in the art even when technological advances provide and warrant improvements.

For example, train scheduling and dispatching is carried out mostly as a separate function with substantial manual operations. Train schedules are initially laid out by planners in train graphs where the projected travel schedule of each train is shown in a position-versus-time plot. The graphs show the locations within the system (called "sidings" in the art) where trains can be switched off the main line for various operational objectives (park, load, unload, reconfigure) and the times when the trains are expected to reach each location. Thus, the graphs also show where and when trains traveling in opposite directions are expected to cross, or trains traveling in the same direction at different speeds are expected to pass one another. FIG. 1 illustrates a typical train graph showing, for example, the progression of two trains (A and B) traveling between locations 25–58 and 47–1, respectively. As shown, trains A and B crossed at location 39 at about 9 am. At the current time of approximately 17 hours (5 pm), highlighted in the train graph by the moving line T, train A has reached and it stopped at location 58, while train B is departing from location 27, where it has been stopped for about two hours, heading toward location 1.

Train graphs are converted into railroad panels to help dispatchers control the flow of train traffic efficiently and safely. Railroad panels consist of schematic representations of the current condition of various yards along the route traveled by each train. FIG. 2 is a portion of such a panel corresponding to the train graph of FIG. 1. Panels are utilized by dispatchers to schedule the use of maneuvering tracks and yards as needed to allow trains to cross or overtake one another at particular locations, or to be reconfigured according to operational objectives and/or constraints. Thus, for example, the dispatcher may have decided that train A should have the right-of-way when trains A and B cross at location 39 because train A is an express train. Similarly, a dispatcher would make decisions regarding priorities for trains due to cross one another in the future, such as trains B and C, or C and D, in FIG. 1. Accordingly, these priorities would be assigned and reflected in the current train graph and corresponding panel and the dispatcher would implement them by taking appropriate action in dealing with the train's conductor and/or with automated controls.

The position of each train is determined in real time by the use of a conventional positioning system, such as GPS, and is communicated to the dispatcher, so that the progress of each train can be followed and compared to the expected schedule expressed in the relevant train graph and panel. When a schedule delay or change occurs, adjustments are made by the dispatcher by manually rearranging the schedule reflected in the train graph and corresponding panel according to predetermined safety and efficiency constraints. For example, if train A had been running late and it had become apparent that it wins would not be able to reach location 39 in time to exert its right-of-way over train B without causing an undesirable delay, the dispatcher would have modified the train graph to reflect that change and any other modification to the schedule of other trains necessitated by the change, so that the correct information would be available for dispatching. Keeping track of each train's position with respect to its schedule and assessing the need or desirability for effecting changes in the train graphs and panels on a current basis is obviously taxing and time consuming for planners and dispatchers. In addition, safety constraints warrant a very conservative approach to making any change to the schedules reflected in active train graphs. Therefore, perturbations to planned train schedules are likely to result in delays and sub-optimal corrections that could be avoided if the process were automated and controlled by an online computerized system under the dispatcher's supervision.

Another area of sub-optimal operation is the use of maneuvering tracks. These are tracks typically present at sidings around the system for switching trains between main tracks (often referred to as "circulation" tracks) and for changing cars between trains. These tracks may be controlled by the railroad's main control center, or may be isolated from the system and left totally to local control. In practice, when a conductor wishes to leave a circulation track and enter a maneuvering zone to carry out a particular task, a request is made from the central control center for the release of the train to local operation within a given block of the maneuvering zone. If the release is granted, the control center isolates the train from the rest of the system and stops accounting for its operations until it returns, subject to further approval, to the circulation track. Thus, the system as a whole is unaware of the specific action or operation carried out on the maneuvering tracks so long as the train in question remains inside the maneuvering zone, thereby preventing any coordination with the operations conducted on the circulation tracks of the railroad system. For example, if a derailment or similar problem occurs, the control center and the dispatcher remain unaware until notified by a person. This lack of coordination is another source of potential hazards and loss of operational efficiency.

A similar problem exists with circulation tracks that need to be taken out of service temporarily for maintenance work. A track warrant (a permission to travel along a given segment of track) and/or a maintenance-of-way (an exclusive permission to be present on a segment of track to perform maintenance work) may be granted upon request to reach and maintain the pertinent segment of rail. The segment is then isolated from the supervision of the control center until the maintenance work is accomplished. During the time control of the operation in the maintenance area is released, the control center is not able to account for the current status and progress of the work. Thus, this information is not accounted for or available to optimize the overall operation of the rail system.

Another common prior-art practice in railroad operation is the use of so-called hot boxes to monitor the condition of car wheels and axles during transit. A hot box consists of a sensor device capable of detecting the temperature of a body passing within a given detection zone. A hot wheel is indicative of a potential bearing breakdown and wheel seizure that could have disastrous consequences. Thus, hot boxes are placed along tracks to monitor the temperature of the wheels of locomotives and cars of trains as they pass by. When a hot spot is detected, the hot box sends a signal to the central station, which in turn is then able to alert the train conductor to effect whatever action may be appropriate under the circumstances. This alarm configuration requires the immediate awareness and manual intervention of an operator, which is often missing as a result of distractions or other intervening constraints. In addition, when a train's schedule is altered as a result of a hot-box alarm, the scheduling changes to the train in question and possibly to other trains within the system are necessarily tied to additional manual operations that require scrutiny for safety concerns and therefore time, as described above. Thus, the urgent response and the immediate system adjustments that could be obtained if the alarm information were communicated directly to the train conductor and were acted upon immediately by the control center are not advantageously achieved in practice.

These examples illustrate the sub-optimal operation of railroad systems even when state-of-the-art technology is utilized. Therefore, it is clear that any form of system integration that improved the efficiency of these and other tasks would constitute a welcome advance in the art. This invention is directed at implementing such an integrated system of operation.

BRIEF SUMMARY OF THE INVENTION

The general objective of this invention is an integrated monitoring and control system for a railroad that permits rapid adjustments to operating parameters in reaction to changes in the system, thereby providing the control infrastructure required for optimal safety and efficiency of operation.

Another objective is a system that makes it possible to account for each operating function and for the extent to which that function affects other operations in the system, so that the effects of perturbations may be analyzed and countered in optimal fashion.

Another object is a system that provides real-time feedback information to planners and dispatchers concerning the effect of any particular proposed change to planned schedules and/or operating conditions.

Yet another object is a system that provides real-time scheduling solutions to planners and dispatchers in response to actual changes to planned schedules and/or operating conditions occurring within the system.

Another goal is a system that is suitable for automated implementation with current railroad safety and operation equipment.

A final objective is a system that can be implemented economically according to the above stated criteria.

Therefore, according to these and other objectives, the broad embodiment of the present invention requires linking each locomotive and/or other moving equipment within the territory covered by the railroad to a control center for communicating data and control signals. Using on-board computers, GPS and two-way communication hardware, rolling stock continuously communicate position, vital sign data, and other information for recording in a data base and for integration in a comprehensive computerized control system. The data base includes train schedules and corresponding railroad panels generated and entered into the system by planners for real time display on monitors and use by dispatchers. The current position of each train, as communicated to the control center, is compared to its planned schedule online to provide immediate information to the dispatcher to determine whether a corrective action is necessary. According to one novel and important aspect of the invention, when a train's deviation from its planned schedule exceeds a predetermined parameter, the system automatically calculates alternative schedules for all trains in the system according to preselected operational constraints as necessary to minimize the effect of the deviation. Thus, the dispatcher is not only alerted of the schedule change, but is also presented with an immediate re-dispatch solution for consideration that accounts for all operational constraints currently in place in the system. If the solution is accepted by the dispatcher, the train graphs and panels in the system are automatically updated to reflect the changes for immediate availability to planners and dispatchers, thereby providing great advantages to the operation in the form of improved efficiency and savings of time and effort.

According to another aspect of the invention, the trains and other moving equipment in the system are equipped with a data processor connected to the system's communication network for receiving, transmitting and processing data, and also with an interactive color graphic console for displaying in real time the same panel information available to dispatchers at the control center. The interactive function of the system allows each conductor the flexibility of requesting track warrants for particular tasks by specifying the request through the console directly to the automated system without participation of a dispatcher. The control system evaluates the availability of the requests within the operating parameters and safety constraints of the overall system and, if available, it grants it directly without requiring further action on the part of dispatchers. The system then automatically updates the panels displayed throughout to reflect the presence of the active warrant. Similarly, when the warrant terminates or is released by the conductor, the system automatically reflects the termination in all displayed panels for general information and consideration. By enabling the process of granting and releasing warrants without dispatcher participation, this feature of the invention provides a very advantageous improvement over current practice by freeing dispatchers from time-consuming and inefficient tasks.

According to yet another aspect of the invention, the automated integration of all current operating data of the system make it possible to quickly analyze the effect of any change by artificially entering it into the system and requesting a simulated response in the form of a re-dispatch schedule. Since the control system is programmed to provide optimal solutions according to desired optimization criteria and within the current operating constraints of the system, optimal solutions to alternative factual scenarios may be developed in real time for the dispatcher's consideration and action. This feature provides a heretofore unknown degree of flexibility to the operation of a railroad.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DESCRIPTION OF THE PREFERRED EMBODIMENTS OF THE INVENTION

As used herein, the term "vital sign" of equipment refers to important operating variables such as pressures and temperatures of hydraulic, water and fuel systems, generator and battery voltages, headlight sensing units, hot-box readings, and any other operating parameter deemed important for safe and efficient maintenance and operation. The term "train control signals" refers to signals provided by the system to monitor and remotely control the safe operation of the train; for example, speeds are controlled to prevent exceeding pre-set limits related to train composition and track condition, and the braking system is monitored for remote override for emergency braking. The term "wayside condition signals" refers to signals provided by the system to monitor the condition or state of equipment and sensors situated along the track system, such as the position of the gate at crossings, the state of derailment detectors, the position of switches and the state of corresponding electric locks, the composition of trains passing by certain locations, the state of traffic signals along the tracks, and the like.

Moreover, it is understood that every reference to a train in this disclosure is intended to apply as well to any other movable piece of equipment that may be found along the tracks of the railroad system or other wayside facility within the communication network of the invention.

Figure 1:
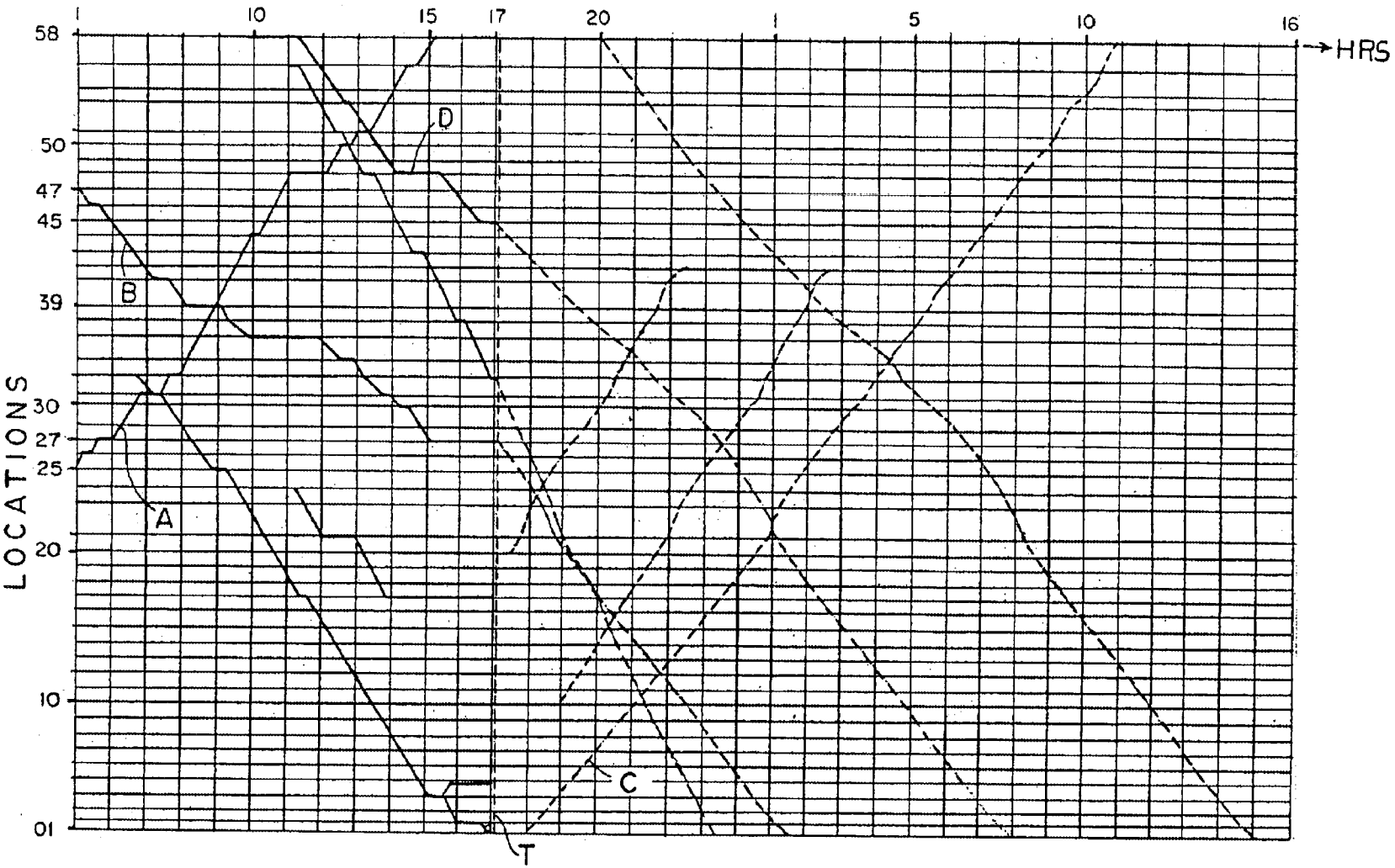
FIG. 1 (PRIOR ART)
FIG. 1 illustrates a typical train graph showing the progression of trains as they travel between locations along their routes.
Figure 2:
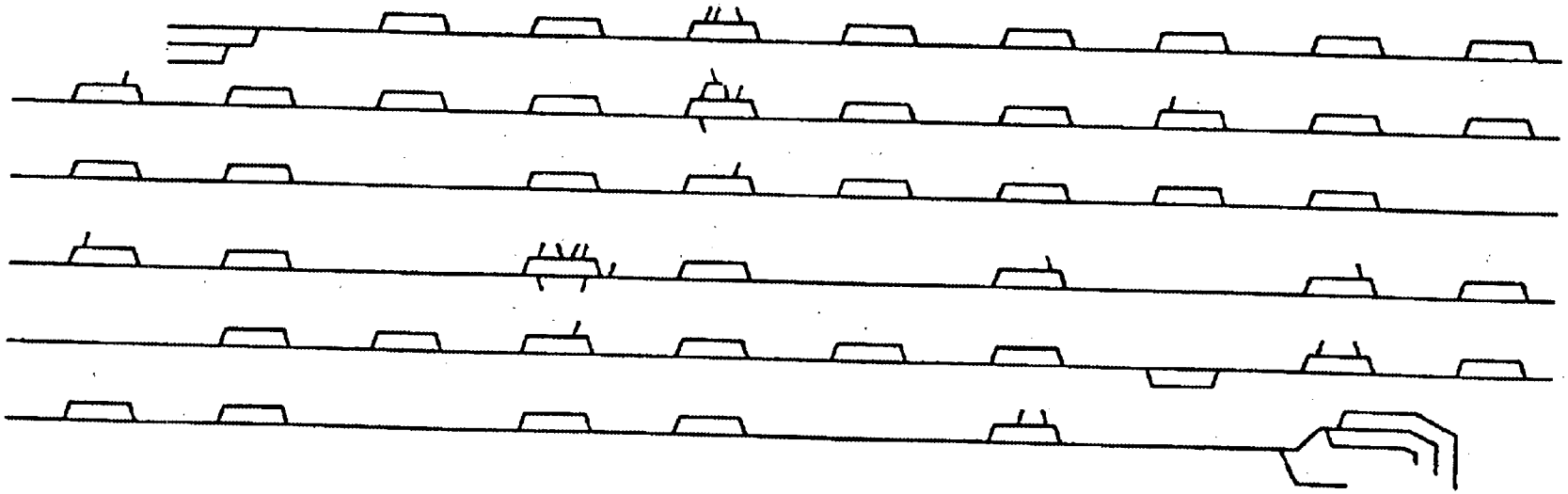
FIG. 2 (PRIOR ART)
FIG. 2 illustrates a portion of railroad panel corresponding to the train graph of FIG. 1.
Figure 3:
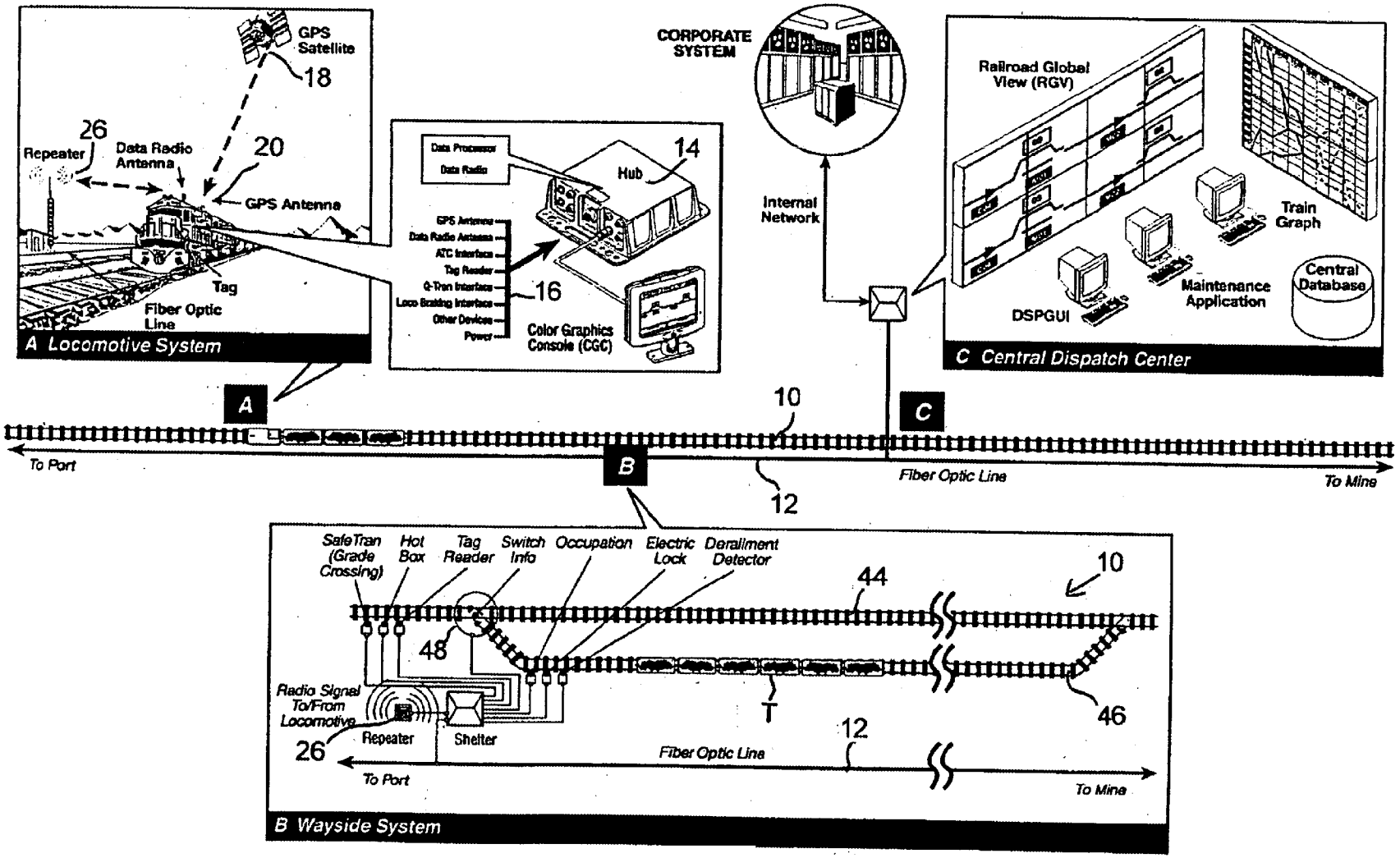
FIG. 3 is a schematic overview of the automated control system of the invention.

Referring to the drawings, wherein like parts are designated throughout with like numerals and symbols, FIG. 3 is a schematic overview of the control system of the invention. The track 10 represents the network of rails in the system and the adjacent fiber-optic line 12 illustrates the ground communications network in place along each track in the system. The overall system includes equipment onboard each train T (represented by a locomotive), illustrated in block A and in FIG. 4; equipment distributed wayside along the tracks, illustrated in block B and in FIG. 5; and a central control and dispatch center, illustrated in block C and in FIG. 6.

Figure 4:
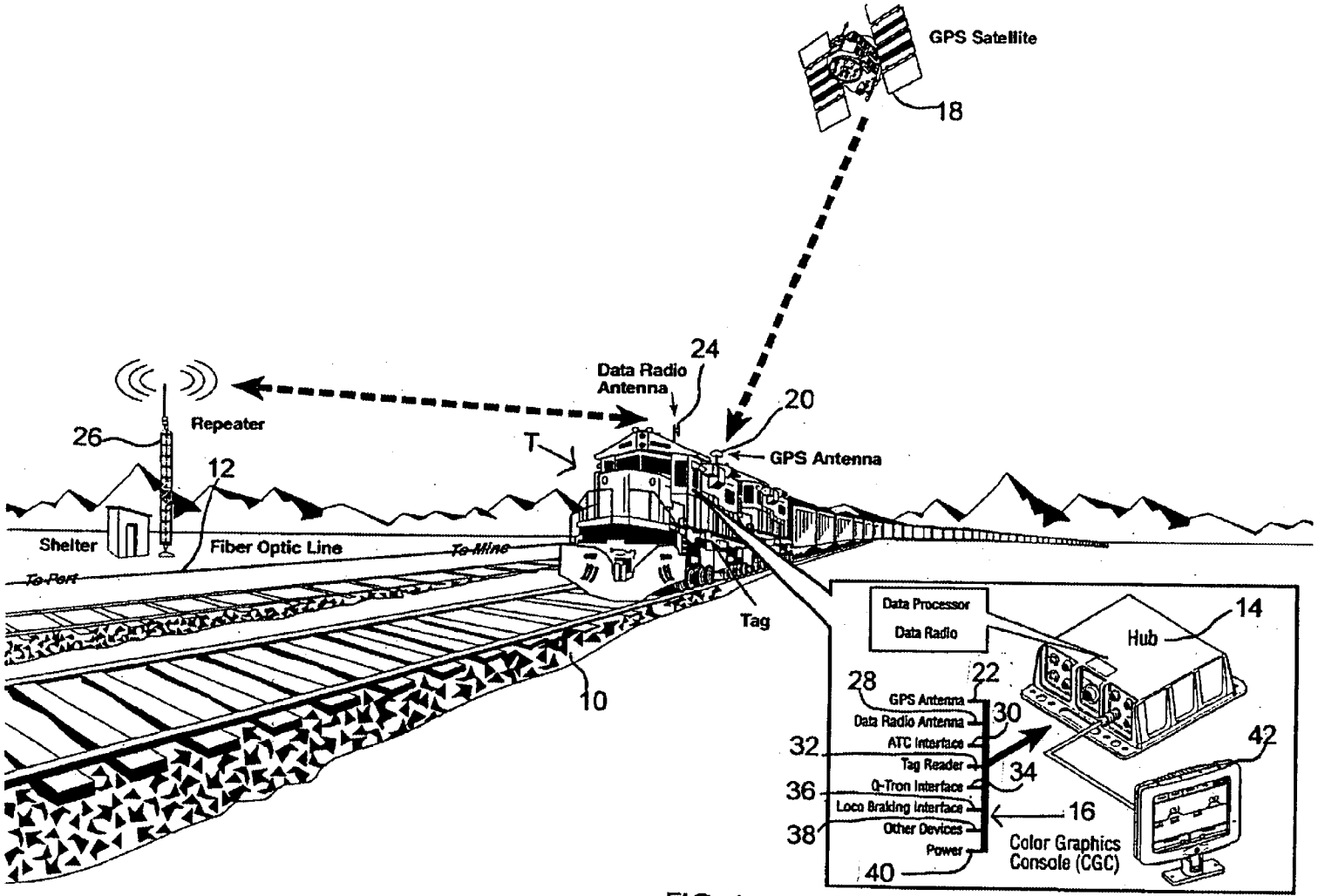
FIG. 4 is a schematic representation of the control systems of the invention associated with moving equipment on the railroad, such a the locomotive of each train.

As shown in FIG. 4, the control system of the invention includes an onboard data processor and communication unit 14 in each locomotive that receives information from various radio and wire data channels 16. Current position information is received from a GPS satellite 18 by means of a GPS antenna 20 on the locomotive. Position information is received by the unit 14 through channel 22 and simultaneously transmitted to the control center through a radio antenna 24, a wayside repeater station 26, and the fiber-optic network 12. The radio antenna 24 also provides a communication channel 28 to transmit data in reverse from the control center to the locomotive, and such data are received for processing by the onboard unit 14. This unit similarly receives and transmits automatic train control signals (such as for emergency braking, speed control, etc.) through a separate channel 30. This channel is used to connect the computer in the control center to all automated functions onboard the train. A separate channel 32 is used to receive, record and transmit signals from mile-mark tag readers placed along the tracks in order to periodically confirm the exact position of the train. These signals are emitted by sensors that detect and identify specific tags place wayside while the train is passing by. Since they are based on precisely fixed markers, the train positions so recorded are used to double-check and, if necessary, correct corresponding GPS positioning data.

Another input/output channel, 34, is provided to receive, record and transmit data from vital-sign sensors on the train, such as pressure and/or temperatures of hydraulic systems and other operating parameters deemed important for safe and efficient maintenance and operation. By transmitting this information to the central data base and by integrating it within the overall control system of the invention, it is possible to monitor continuously the condition of all essential components of the train and provide a real-time backup for signalling any condition that warrants an alarm. Yet another channel 36 in unit 16 is used to provide a redundant brake-control system, if desired or required. Finally, an additional channel 38 is provided for use with any other onboard device that may need to be connected for integration within the overall control system, and a channel 40 is dedicated to energize unit 14 from an onboard power source.

The data processor and communication unit 14 is also connected to an onboard color graphic console or monitor 42 which, in real time, displays information relevant to the operation of the corresponding train. For example, the portion of the railroad panel that includes the area being traveled by the train is shown and updated on a current basis to show the same information displayed on the complete panel board at the control center. Information regarding active warrants, maintenance-of-way zones, and other useful data is also shown and updated in real time for the conductor's use. Moreover, the console 42 is utilized interactively to communicate with the automatic control system to request warrants without the need for dispatcher participation, as mentioned above. That is, the conductor may use the console to identify (such as by touch) a segment of track on the displayed panel for which he or she requests a warrant. The control center determines whether or not the warrant can be granted safely and efficiently within the operating parameters built into the system and automatically grants or denies the warrant to the conductor without the intervention of a dispatcher. At the same time, both the request and the response are communicated and displayed in the corresponding control-center panel for the dispatcher's knowledge and, if necessary, for his or her intervention to override the automatic response.

Figure 5:
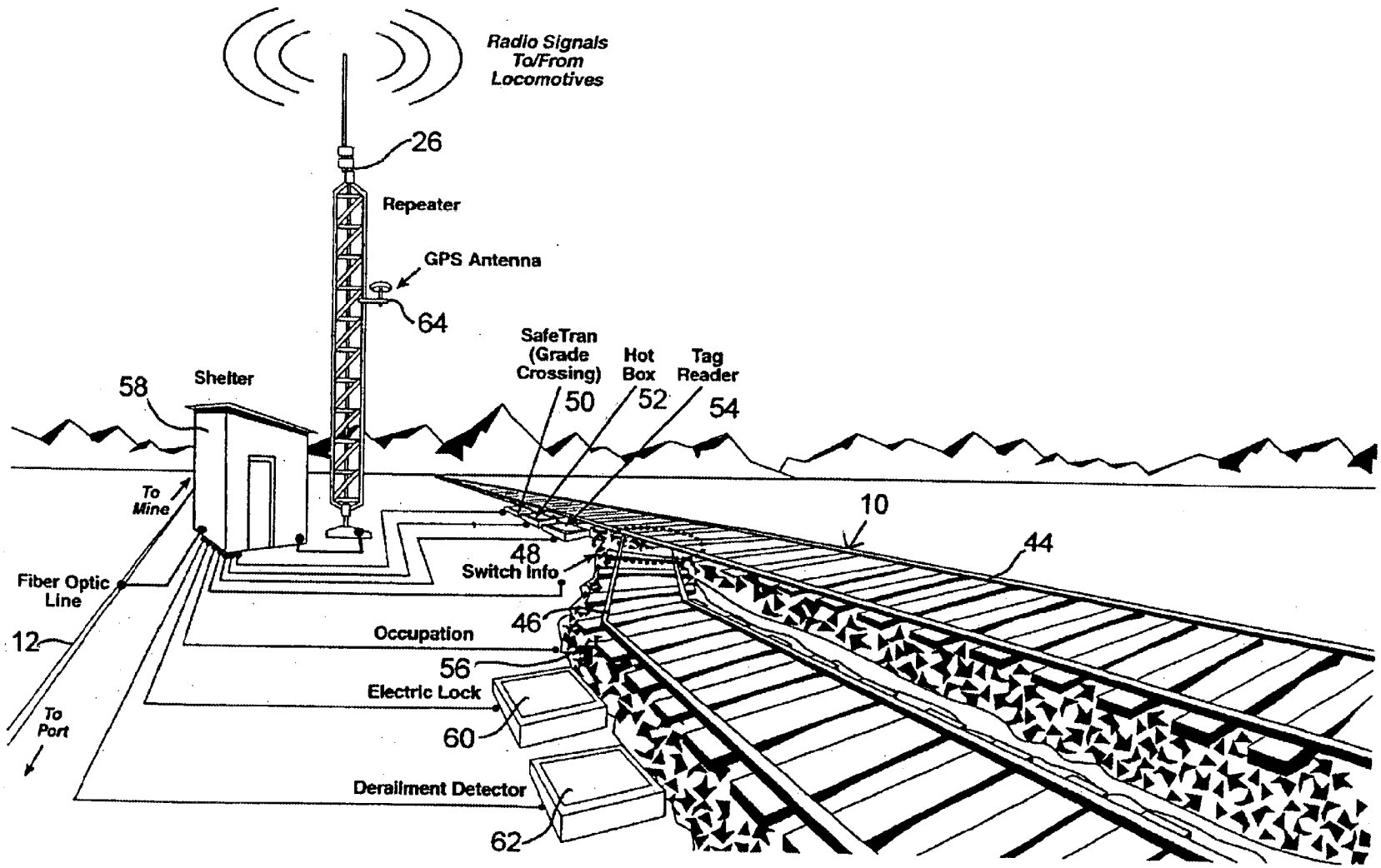
FIG. 5 is a schematic representation of the control systems of the invention associated with wayside equipment along the railroad.

The wayside part of the control system of the invention is illustrated schematically in block B of FIG. 3 and in FIG. 5. All railroad networks 10 comprise main lines 44 (also called circulation tracks) between recurring sidings and yards where trains may be diverted to maneuvering tracks 46 by remotely controlled switching mechanisms 48. Maneuvering tracks are used, for instance, to remove the train from the main line in order to load or unload cars; to change the makeup of a train by dropping or adding cars; to perform emergency maintenance on rolling stock; to allow a faster train to pass ahead of a slower one; or to allow the crossing of trains moving in different directions. In all cases, the diversion of a train is accomplished by means of a conventional switch 48 that is controlled by a signal received from the control center through the fiber-optic network 12 or from the train through the repeater 26 (such as when control is turned over to the train conductor by the granting of a warrant).

The wayside system includes various components that are illustrated for convenience at a siding in FIG. 5, but are in fact spread at useful intervals along the tracks of the system. These include grade-crossing equipment 50, such as barriers and alarm signals, to prevent crossing of tracks by automotive traffic when a train is present. The operation of equipment 50 is controlled remotely, typically from the control center, through the communication system provided by the fiber-optic and repeater-tower network. Hot box equipment 52, which consists of sensors placed along the tracks to detect the temperature of each wheel in a car, is similarly integrated within the system. When a sensor in equipment 52 detects an axle temperature above a predetermined safe threshold, an alarm is transmitted in real time to the control center and the locomotive conductor through the communication network for immediate alert and consideration for responsive action. Because hot-box equipment is capable of keeping track of the position of each wheel within the train for which a measurement is taken, the exact car and location of a particular hot spot can also be identified and communicated through the system.

Compositional tag-reader equipment 54 is typically placed at yards and at both ends of sidings to check the make-up of each train passing by. Each car and locomotive in the system carries an identifying tag with information regarding its identity and attributes. Tag readers 54 capture this information and feed it to the system through appropriate communication lines every time the car or locomotive passes by, thereby providing an accurate inventory of the make-up of each train both before they enter and after they leave a particular yard or siding. The state of each signal along the tracks is also monitored continuously by means of signal sending units and corresponding lines connecting the signal sights to a convenient wayside distribution center 58 where all wayside signals are collected and distributed throughout via the fiber-optic line 12 or the radio repeater station 26.

As a safety measure, each switch 48 on the tracks is typically equipped with an electric lock 60 to prevent manual switching. The lock is controlled remotely, typically by the control center in the system. If manual operation is desired, such as in cases when control is released to local operation in maintenance-of-way or maneuvering zones, the system of the invention enables the concurrent release of control over the switch by deactivating the electric lock 60. Finally, the invention also integrates into the overall control system the information generated by derailment detectors 62 scattered throughout the rail network. These detectors vary in kind from simple mechanical levers to sophisticated optical instruments positioned alongside the track to detect any wheel that is not riding on the rail, such as might result from a broken axle, in order to provide an early warning of a potential derailment situation. By connecting all equipment according to the invention, an immediate warning can be generated and transmitted to the conductor of the train in question. It is noted that the wayside system may also include a stationary antenna 64 used in conventional differential GPS to refine the precision of the global positioning system.

Figure 6:
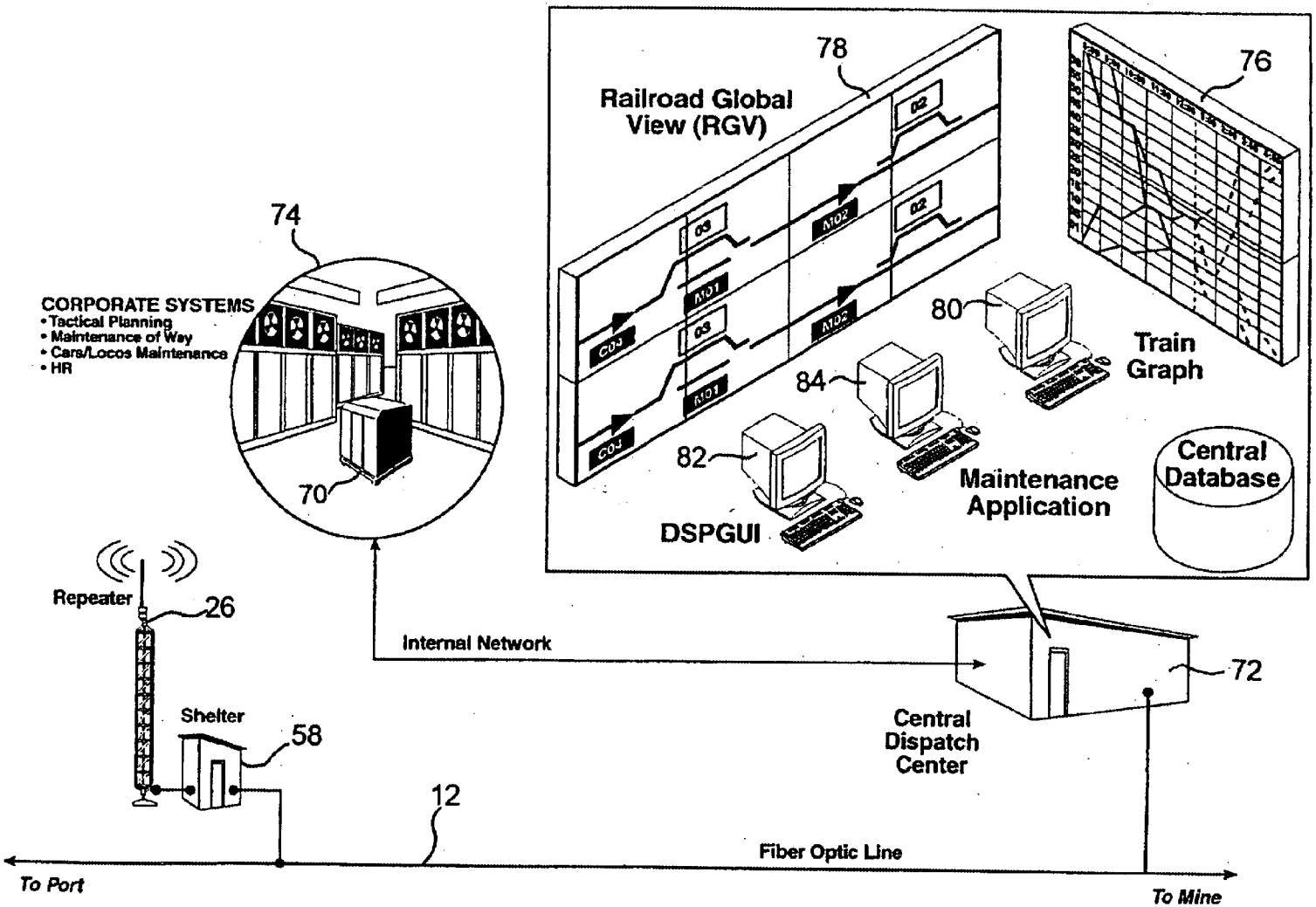
FIG. 6 is a schematic representation of the control systems of the invention associated with equipment at the control and dispatch center of the system.

FIG. 6 illustrates schematically the components of the central control and dispatch system of the invention. A central computer 70, which may be located within a dispatch center 72 or at corporate center 74, is programmed to receive and integrate all signals provided by the communication network into an overall dynamic model of the system. It includes interactive software for composing train graphs 76, which are then automatically converted into railroad panels 78. Both are displayed conventionally in large boards at the dispatch center 72, but are also available for interactive manipulation at planner stations 80 and dispatch stations 82. The model also includes software for monitoring every piece of information received from the communication network and for ensuring that it falls within predetermined expected parameters of operation. When a signal indicates that a parameter has been exceeded or has not been met within an acceptable tolerance, such as a greater-than-acceptable train delay or a positive signal from a derailment detector, the computerized model calculates prospective changes to the current train graphs and panels according to predetermined optimization criteria (so called objective functions in the art of optimization) and within the operating constraints of the system. For example, an optimization criterion may be to minimize overall passenger-train delays regardless of the effect on freight-train schedules; or an alternative criterion may be to maximize freight tonnage transported to a given location irrespective of consequences to all other trains. Similarly, system operating constraints would be predetermined required stops for each train, maximum speed limits for each train composition on various segments of track; travel restriction due to active maintenance-of-way and track-warrant zones, and any other constraint that the railroad management wishes to impose on the system.

Figure 7:
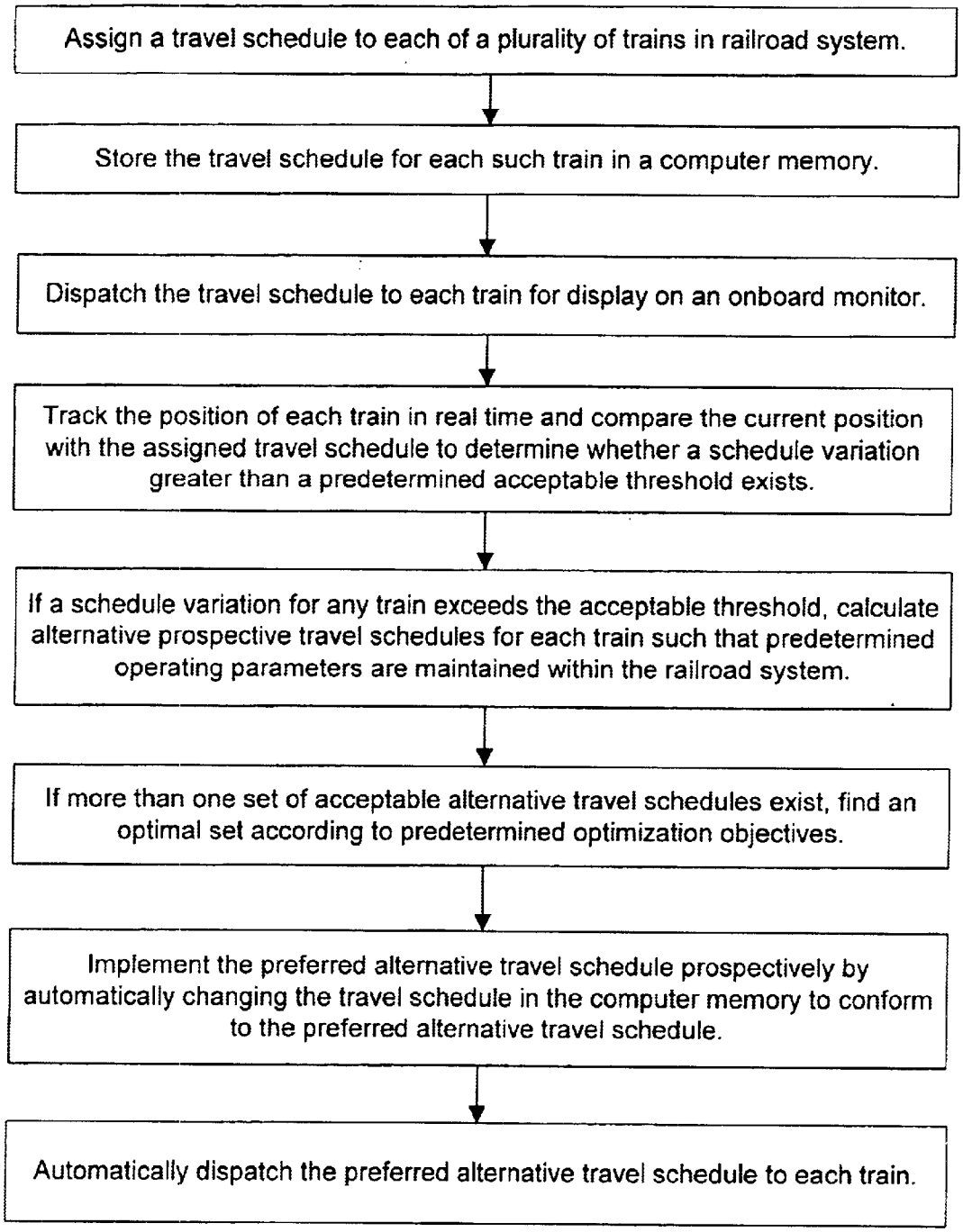
FIG. 7 is a flow diagram illustrating the steps involved in implementing the automated traffic control system of the invention.

As a result of the computerized, automated, real-time data collection and response of the control system of the invention, the alternative scheduling solutions to schedule variations caused by unplanned occurrences within the rail system can be immediately evaluated and accepted or rejected by planners and dispatchers manning stations 80,82. The system may also be integrated with general corporate plans such as long-term scheduling priorities, maintenance programs, and personnel schedules, all of which are additional operating constraints to be accounted for by the control system of the invention. Accordingly, a specific station 84 may be provided for use by maintenance personnel. FIG. 7 is a schematic diagram of the various steps involved in the automated control scheme of the invention.

Figure 8:
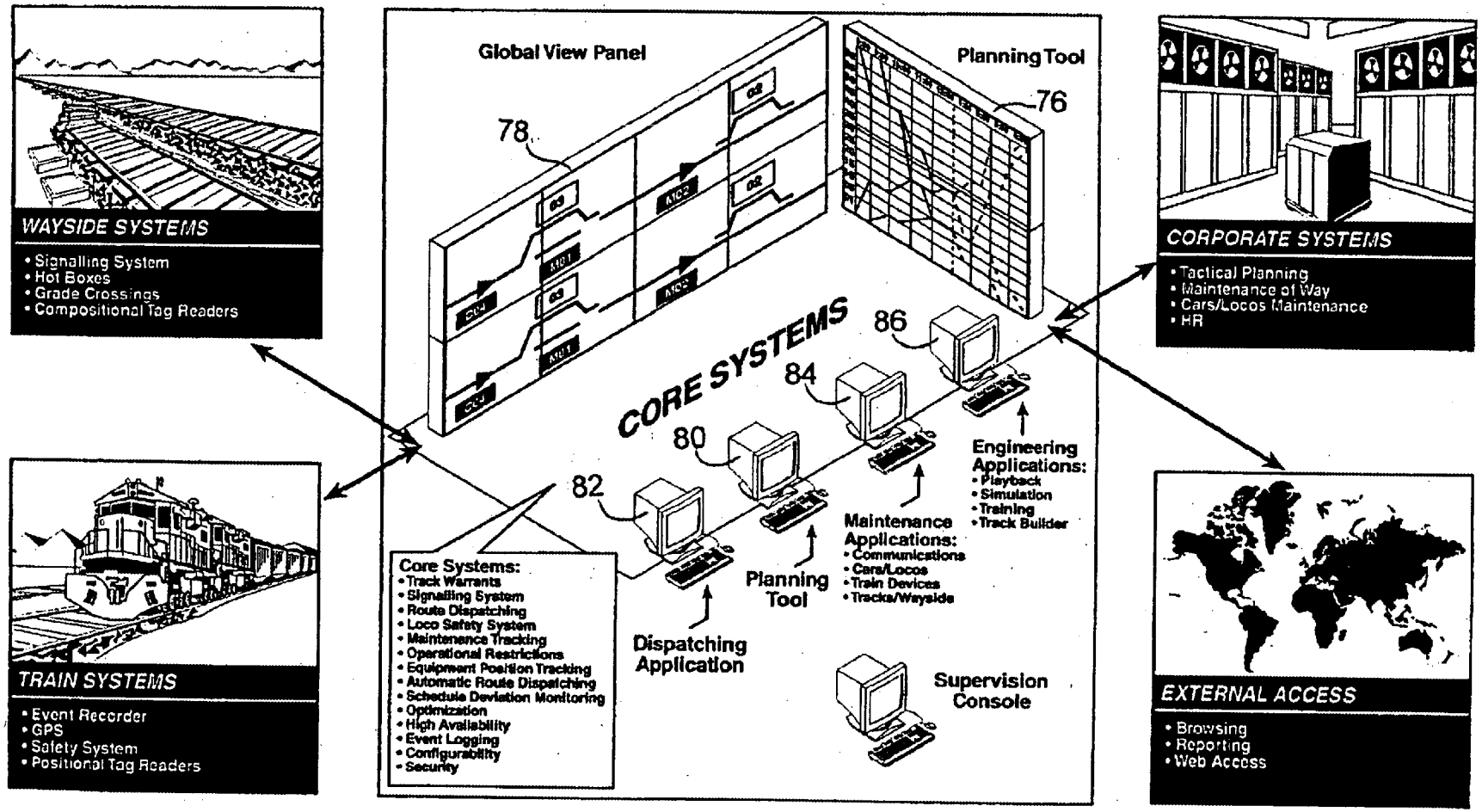
FIG. 8 is an overview of the multiplicity of operations managed directly by the control center of the railroad system as a result of the complete integration of all functions into a single computerized system according to the invention.

FIG. 8 is an overview of the multiplicity of operations managed directly by the control center of the railroad system as a result of the complete integration of all functions into a single computerized system according to the invention. By virtue of the complete and current data base available, the system can also be used for simulation of the effect of engineering alternatives on the system, for training, and for any other function that requires the availability of a dynamic system model. An interactive monitor station 86 is shown in FIG. 8 to illustrate this capability of the invention. Finally, the real-time communication capability afforded by the system of the invention to every operator within the network is also conducive to internet connection for research, reporting, and other similar functions, as illustrated in the figure.

Various changes in the details, steps and components that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent apparatus and procedures.

We claim:

1. In a railroad system wherein a plurality of trains is operated over multiple interconnected tracks, a traffic-control system comprising the following combination of components:

(a) means for assigning a travel schedule to each of a plurality of said trains and for storing said schedule in a computer memory;

(b) means for determining each train's position as the train progresses along said tracks;

(c) means for comparing said train's position with said travel schedule assigned thereto to produce a compliance indicator indicative of a schedule variation for the train;

(d) means for calculating, when said schedule variation exceeds a predetermined acceptable threshold, an alternative travel schedule for each of said plurality of trains as necessary to maintain predetermined operating parameters within the system; and (e) means for automatically changing said travel schedule of each train in the computer memory to conform prospectively with said alternative travel schedule.

2. The traffic control system of claim 1, further including processing means for optimizing, according to a predetermined optimization objective, said function of calculating an alternative travel schedule for each of said trains.

3. The traffic control system of claim 1, further including means for automatically dispatching said alternative travel schedule to the train.

4. The traffic control system of claim 3, further including means for displaying said alternative travel schedule onboard the train.

5. The traffic control system of claim 1, further including means for receiving and storing in said computer memory operating data indicative of equipment vital signs.

6. The traffic control system of claim 5, further including means for comparing said operating data with corresponding acceptable ranges of operation and for automatically producing an alarm when a vital sign is outside a corresponding acceptable range of operation.

7. The traffic control system of claim 6, further including means for calculating, when said vital sign is outside the corresponding acceptable range of operations, a modified travel schedule for each of said plurality of trains as necessary to maintain predetermined operating parameters within the system.

8. The traffic control system of claim 7, further including processing means for optimizing, according to a predetermined optimization objective, said function of calculating a modified travel schedule for each of said trains.

9. The traffic control system of claim 1, further including means for receiving and storing train control signals in said computer memory.

10. The traffic control system of claim 9, further including means for comparing said train control signals with corresponding acceptable ranges of operation and for automatically producing an alarm when a train control signal is outside a corresponding acceptable range of operation.

11. The traffic control system of claim 1, further including means for receiving and storing mile-mark tag reader signals in said computer memory.

12. The traffic control system of claim 11, further including means for comparing said mile-mark tag reader signals with said train's position and for automatically producing an alarm when a mile-mark tag reader signal does not coincide with said train's position within a predetermined acceptable tolerance.

13. The traffic control system of claim 1, further including means for receiving and storing wayside condition signals in said computer memory.

14. The traffic control system of claim 13, further including means for comparing said wayside condition signals with expected reference parameters and for automatically producing an alarm when a wayside condition signal does not conform with said expected reference parameter.

15. The traffic control system of claim 1, further including:

means for automatically dispatching said alternative travel schedule to the train;

means for displaying said alternative travel schedule onboard the train;

means for receiving and storing in said computer memory operating data indicative of equipment vital signs, train control signals, mile-mark tag reader signals, and wayside condition signals; and means for comparing said operating data, train control signals, mile-mark tag reader signals, and wayside condition signals with corresponding acceptable operational parameters and for automatically producing an alarm when an operating datum, a train control signal, a mile-mark tag reader signal, or a wayside condition signal does not conform with a corresponding acceptable operational parameter.

16. The traffic control system of claim 15, further including processing means for optimizing, according to a predetermined optimization objective, said function of calculating an alternative travel schedule for each of said trains.

17. The traffic control method of claim 1, further including the step of receiving and storing in said computer memory operating data indicative of equipment vital signs.

18. The traffic control method of claim 17, further including the step of comparing said operating data with corresponding acceptable ranges of operation and for automatically producing an alarm when a vital sign is outside a corresponding acceptable range of operation.

19. The traffic control method of claim 18, further including the step of calculating, when said vital sign is outside the corresponding acceptable range of operations, a modified travel schedule for each of said plurality of trains as necessary to maintain predetermined operating parameters within the method.

20. The traffic control method of claim 19, further including the step of using an electronic processor to optimize, according to a predetermined optimization objective, said step of calculating a modified travel schedule for each of said trains.

21. A method for controlling traffic in a railroad system wherein a plurality of trains is operated over multiple interconnected tracks, said method comprising the following steps:

(a) assigning a travel schedule to each of a plurality of said trains and storing said schedule in a memory of an electronic processor;

(b) determining each train's position as the train progresses along said tracks and storing the position in said memory;

(c) utilizing said electronic processor for comparing said train's position with said travel schedule assigned thereto and for producing a compliance indicator indicative of a schedule variation for the train;

(d) utilizing said electronic processor for calculating, when said schedule variation exceeds a predetermined acceptable threshold, an alternative travel schedule for each of said plurality of trains as necessary to maintain predetermined operating parameters within the system; and (e) automatically changing said travel schedule of each train in the memory of the electronic processor to conform prospectively with said alternative travel schedule.

22. The traffic control method of claim 21, further including the step of optimizing, according to a predetermined optimization objective, said step of calculating an alternative travel schedule for each of said trains.

23. The traffic control method of claim 21, further including the step of automatically dispatching said alternative travel schedule to each of said trains.

24. The traffic control method of claim 23, further including the step of displaying said alternative travel schedule onboard the train.

25. The traffic control method of claim 21, further including the step of receiving and storing train control signals in said computer memory.

26. The traffic control method of claim 25, further including the step of comparing said train control signals with corresponding acceptable ranges of operation and for automatically producing an alarm when a train control signal is outside a corresponding acceptable range of operation.

27. The traffic control method of claim 21, further including the step of receiving and storing mile-mark tag reader signals in said computer memory.

28. The traffic control method of claim 27, further including the step of comparing said mile-mark tag reader signals with said train's position and for automatically producing an alarm when a mile-mark tag reader signal does not coincide with said train's position within a predetermined acceptable tolerance.

29. The traffic control method of claim 28, further including the step of receiving and storing wayside condition signals in said computer memory.

30. The traffic control method of claim 29, further including the step of comparing said wayside condition signals with expected reference parameters and for automatically producing an alarm when a wayside condition signal does not conform with said expected reference parameter.

31. The traffic control method of claim 21, further including the following steps:

(f) automatically dispatching said alternative travel schedule to the train;

(g) displaying said alternative travel schedule onboard the train;

(h) receiving and storing in said computer memory operating data indicative of equipment vital signs, train control signals, mile-mark tag reader signals, and wayside condition signals; and (i) comparing said operating data, train control signals, mile-mark tag reader signals, and wayside condition signals with corresponding acceptable operational parameters and for automatically producing an alarm when an operating datum, a train control signal, a mile-mark tag reader signal, or a wayside condition signal does not conform with a corresponding acceptable operational parameter.

32. The traffic control method of claim 31, further including the step of using an electronic processor to optimize, according to a predetermined optimization objective, said step of calculating an alternative travel schedule for each of said trains.

* * * * *

UNITED STATES PATENT AND TRADEMARK OFFICE

CERTIFICATE OF CORRECTION

PATENT NO. : 6,799,097 B2 
DATED : September 28, 2004
INVENTOR(S) : Marco Antonio Villarreal Antelo et al.

It is certified that error appears in the above-identified patent and that said Letters Patent is hereby corrected as shown below:

Column 2,
Line 7, delete "wins"

Signed and Sealed this

Seventeenth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,799,097 B2 
DATED : September 28, 2004
INVENTOR(S) : Marco Antonio Villarreal Antelo et al.

It is certified that error appears in the above-identified patent and that said Letters Patent is hereby corrected as shown below:

Column 10,
Line 39, replace "1" with -- 21 --.

Signed and Sealed this

Seventh Day of February, 2006

JON W. DUDAS
*Director of the United States Patent and Trademark Office*